US005816738A

United States Patent [19]

Harnapp

[11] Patent Number: 5,816,738

[45] Date of Patent: Oct. 6, 1998

[54] COMPOSITE SYNTHETIC MATERIAL TILE AND SUITABLE LAYING SYSTEM AND LAYING PLATE THEREFOR

[75] Inventor: Bernd Harnapp, Heiligenhaus, Germany

[73] Assignee: ABO System-Elemente GmbH, Germany

[21] Appl. No.: 965,815

[22] Filed: Nov. 7, 1997

Related U.S. Application Data

[63] Continuation of Ser. No. 640,892, Oct. 3, 1996, abandoned.

[51] Int. Cl.[6] ..... E01C 5/22; E01C 5/00

[52] U.S. Cl. ..... 404/18; 404/34; 404/37; 404/40; 404/41; 404/44; 404/53

[58] Field of Search ..... 404/17, 18, 34, 404/37, 40, 41, 44, 53

[56] References Cited

U.S. PATENT DOCUMENTS

| | | | |
|---|---|---|---|
| 710,062 | 9/1902 | Leary . | |
| 2,026,224 | 12/1935 | Drehmann . | |
| 3,238,682 | 3/1966 | Tracy et al. | 404/18 |
| 3,500,606 | 3/1970 | Wharmby . | |
| 3,775,918 | 12/1973 | Johnson . | |
| 4,584,221 | 4/1986 | Kung | 428/44 |
| 4,671,699 | 6/1987 | Roach | 404/41 |
| 4,749,302 | 6/1988 | DeClute | 404/37 |
| 4,917,532 | 4/1990 | Haberhauer et al. . | |
| 4,963,054 | 10/1990 | Hayashi | 404/34 |
| 5,006,011 | 4/1991 | Hiyashi | 404/37 |
| 5,403,637 | 4/1995 | Pickard et al. . | |

FOREIGN PATENT DOCUMENTS

| | | |
|---|---|---|
| 524609 | 7/1992 | European Pat. Off. . |
| 9101959 | 8/1991 | Germany . |
| 4143228 | 1/1993 | Germany . |
| 9310473 | 10/1993 | Germany . |
| WO 9220885 | 11/1992 | WIPO . |

*Primary Examiner*—Tamara L. Graysay
*Assistant Examiner*—Gary S. Hartmann
*Attorney, Agent, or Firm*—Vickers, Daniels & Young

[57] ABSTRACT

Floor coverings of composite tiles having a polygonal ground plan and having elastic properties. A recess which is formed of a hollow space in the composite tiles can include a cylindrical support molded on the underside of the tiles. The walls of each composite tile can be stabilized by a supporting component which is connected to the vertical edges of the composite tiles and preferably extends to the lower edge of the tiles. Laying plates which include an arrangement designed to co-operate with the supports of the composite tiles can be used. The laying plates form a laying system which permits the laying of the composite tiles even on difficult substrates and provide for the laid composite tiles to be easily be lifted.

48 Claims, 4 Drawing Sheets

COMPOSITE SYNTHETIC MATERIAL TILE AND SUITABLE LAYING SYSTEM AND LAYING PLATE THEREFOR

This is a continuation of application Ser. No. 08/640,892 filed on Oct. 3, 1996.

The present invention relates to the art of a composite paving element, a system for installing the composite element and an installation slab suitable for installing the composite element.

Composite paving elements, like those used to pave areas or paths used in quite different ways, are known in many different variants. Composite paving stones made of wood or concrete are common, which exhibit a certain absorption capacity, especially with respect to water, so that rain water, for example, can reach the ground despite covering of the soil by the composite paving stones.

Surfaces covered with such composite paving, especially when the composite paving elements are based on concrete, exhibit a hard, sometimes even brittle surface. In numerous applications of composite paving elements, for example, in playgrounds or sports fields or even in stalls for animal keeping, the use of composite paving elements with an elastic surface is advantageous.

A paving element hollow on the inside made of a rubber-like material is already known from DE 38 09 629 A1, whose lower region is intended for introduction into an installation bed, which preferably should consist of mortar or highly plastic concrete. The lower region carries penetration-limiting protrusions on its inside so that the paving element can only be forced into the installation bed up to a specified, defined depth with its lower region. Because of this an inner, air-filled cavity remains in the installed paving element that is fully sealed off from the surroundings. During indentation of the paving element caused by a load the air situated in the interior is therefore compressed so that the air cushion has a supporting effect on the surface of the paving element.

However, a drawback in this variant is that liquid occurring on the surface of the pavement cannot run off into the ground owing to the tightness of the employed rubber-like plastic material.

This problem is solved by the drainage system for ground coverings made of composite paving elements known from EP 0 524 609 A1 in that paving joints of constant width are provided between adjacent composite paving elements hollow on the inside, as well as recesses in the side walls of the composite paving elements, which join the paving joints to the interior of the composite paving element. Because of this expedient surface water (even in large amounts) can be introduced quickly to the interior of the composite paving element and (provided the ground is absorptive) absorbed by the ground or, when the pavement is installed on more or less water-impermeable ground, fed to a drain on the surface of the ground.

The composite pavement known from EP 0 524 609 A1 is produced from recycled plastic, since no special requirements need be imposed on the properties of the material used for its manufacture. In addition to the capability of effectively diverting surface water, this pavement is characterized in particular by its ecologically compatible manufacturing capability. It is also resistant to nearly all aggressive influences that occur, for example, most acids, excrement and urine. The pavement is also absolutely maintenance-free, abrasion-resistant, weather- and frost-resistant and very dimensionally stable because of the only limited moisture absorption and an only limited thermal expansion coefficient and is therefore simple to install and amenable to repair, since replacement of composite paving elements in places can occur without adjusting the dimensions of the newly inserted elements.

The aforementioned favorable properties of the composite pavement known for EP 0 524 609 A1, however, are partially offset by some shortcomings that will be explained below. Thus, recycled plastic is indeed well suited in principle for production of this composite pavement, but the wall thicknesses must be increased because of the reduced strength values of recycled plastic in comparison with unrecycled plastic, which has an adverse effect on the manufacturing cost and on the weight of the composite paving elements. This effect is further increased by the fact that wall regions serving to stabilize an installed paving element through the lateral openings that serve for drainage and the internal air cushion cannot be utilized, since material weakness and exchange of internal air with the surroundings are caused by the openings. The pavement, when installed on relatively soft ground, as is often encountered in playgrounds or camping areas, has a tendency to subside into the ground so that the inside of the "pavement top" comes to lie on the ground. In addition to reduced drainage capacity, subsidence is accompanied by a loss of the elasticity that is advantageous for many applications, since the pavement top no longer can "give" downward when loaded.

SUMMARY OF THE INVENTION

The underlying task of the invention is therefore to develop a composite paving element from plastic, preferably recycled, in which the desired elastic properties are achieved with a simultaneous saving of material. Nevertheless, all the design features and properties, especially drainage capacity, of the paving element according to EP 0 524 609 A1 are to be attainable. At any rate, the paving element is to be made accessible for installation on difficult soils, for example, soft sandy soils.

The disadvantages of prior composite pavings are overcome by using a composite paving element having a polygonal outline made of plastic, preferably recycled plastic, with a central recess arranged in the bottom surface, with side walls running roughly perpendicular to the paving top of composite paving element and with vertical edges formed from the side walls, and also including a continuous rib extending roughly perpendicular from the paving top is provided in the central recess and is connected to the vertical edges of the composite element via roughly radial diagonal ribs. The paving element is preferably installed by using installation slabs preferably made of recycled plastic, on which fasteners for the composite paving elements are provided and that the fasteners are designed so that neighboring installation slabs are held together by the emplaced composite paving elements. Preferably, the spacing between neighboring fasteners and also between adjacent installation slabs via the installation slab edges is constant.

Owing to the fact that a continuous rib extending almost perpendicular from the top is provided in a central recess forming an internal volume in the composite paving element, which is connected to the vertical edges of the polygonal composite paving element via roughly radially running diagonal ribs, significant shape retention capacity of the composite paving element is achieved with simultaneously high elasticity. Because of the embodiment of a composite paving element according to the invention it is therefore possible to significantly reduce the wall thicknesses relative to ordinary composite paving elements without reducing loadability in so doing. The continuous rib extending roughly perpendicular from the top in the central recess also leads to reinforcement of the top but without introducing forces during loading of the top into the side walls, by means of whose lower edges, preferably provided with edge recesses, the composite paving element is supported on the installation base. The additionally provided diagonal ribs that connect the continuous rib to the side walls are not connected to the central regions of the side walls (as is known for stiffening of flat wall surfaces), but directly to the vertical edges, i.e., to the wall edges that already naturally exhibit the highest shape rigidity. This expedient surprisingly leads to a significant increase in shape rigidity of the entire composite paving element, in which, on the one hand, best possible support of the top occurs and, on the other hand, an embodiment of the composite paving element with edge openings (known from EP 0 524 609 A1), which are provided in the side walls and serve for drainage capability of a composite paving element made of recycled plastic, is made possible.

In the preferred variant of the composite paving element the continuous rib is formed from a support element with a cylindrical surface. On the one hand, this embodiment leads to particularly uniform stiffening of the pavement top and, on the other hand, to effective force coupling to the diagonal ribs without stress increases occurring on the edges, which could lead to crack formation from material fatigue of a repeatedly loaded composite paving element.

Another advantage of the plastic composite paving elements is the possibility of being able to optimally adjust the elastic properties of the composite paving element to the corresponding application by changing the composition of the plastic employed to produce the composite paving element and/or by adjustments of the stiffening ribs provided in the central recess. This can occur in that the diagonal ribs have a lower edge recess whose shape or dimension can be adjusted to the required flexibility. The edge recesses also guarantee that surface water flowing off via the paving joints can be evenly distributed within a composite paving element on the ground.

A composite paving element according to the invention can be produced particularly thin-walled and flat if the lower edge of the support element lies in one plane with the lower edge of the composite paving element. It is then also expedient to provide on the support element a means to anchor the composite paving element to an appropriate installation slab whose function will be further explained below. The means of anchoring can advantageously consist of an all-round groove incorporated in the inside cross section of the support element or of an extension from the lower edge of the support element whose outside contour has a continuous or several separate protrusions.

An installation appropriate for composite paving elements according to the invention preferably includes an installation slabs on which fasteners for composite paving elements are provided and that the fasteners are designs so that neighboring installation slabs are held together by the emplaced composite paving elements. Preferably, the installation slabs are made produced from recycled plastic. Fasteners for the composite paving elements are provided on the installation slabs, which can mesh with the fasteners provided on the composite paving elements and thus serve, on the one hand, for attachment of the composite paving elements themselves to the installation slabs and on the other hand, at least optionally (i.e., expendably) serve for attachment of neighboring installation slabs to each other by composite paving elements spanning their parting line.

An installation slab particularly suitable for use in the installation system according to the invention, in which the spacing between adjacent fasteners is constant, even if these are situated on adjacent installation slabs, is preferably used. A relatively limited size and thus simple transportability of the installation slabs, as well as maximum variability during installation of the composite paving elements according to the invention, are achieved by this feature.

The fasteners are particularly suited for achievement of fixed emplacement of a composite paving element according to the invention on an installation slab if they consist of pot-like retaining knobs that protrude from the installation slab, which have a radially protruding edge that meshes with the inside cross section of the support element, especially with an all-round groove made in it after positioning and subsequent pressing of a composite paving element.

An installation slab is particularly suited for fastening of a composite paving element according to the invention in the variant, in which the fasteners consist of incorporated openings that have undercuts on the side facing away from the composite paving element in which the protrusions provided on the extension of the support element lock the composite paving element into place after emplacement.

Because of this type of installation system consisting of composite paving elements and installation slabs, on the one hand, sinking of the composite paving element (hollow on the bottom) in soft ground, as is present, in particular, at campsites, playgrounds and sporting areas, is avoided, while, on the other hand, the installation process is significantly simplified, during which in the case of several installation mats the adjacent installation mats are fixed to each other by the spanning composite paving elements. Paving elements can also be easily taken up and, like the installation slabs, reused. A true hollow-chamber composite paving element is also created by this installation system, which can be manufactured in the simplest manner despite its excellent properties. At any rate, this installation system is also suitable in conjunction with composite paving elements having other designs and configurations.

In summary, the invention pertains to a composite paving element with a polygonal outline made of plastic, preferably recycled plastic. The paving element includes a central recess arranged in the bottom surface side walls running roughly perpendicular to the paving top of composite paving element and with vertical edges formed from the side walls. A continuous rib extends roughly perpendicular from the paving top is provided in the central recess and the continuous rib is connected to the vertical edges of the composite element via roughly radial diagonal ribs. Preferably, the continuous rib is formed from a cylindrical support element. In addition, the diagonal ribs preferably have a lower edge recess. The lower edge of support element preferably lies in a plane with the lower edges of composite paving element. In addition, there is preferably provided an arrangement to anchor the composite paving element to an installation slab and such arrangement is preferably provided on the support element. The anchoring arrangement preferably includes an all-round groove made in the inside cross section of support element. Furthermore, the anchoring arrangement preferably includes an extension extending from the lower edge of support element, which includes a continuous or several individual protrusions on its outside cross section. An installation system for composite paving elements is preferably provided and includes installation slabs, preferably made of recycled plastic, on which fasteners for the composite paving elements are provided and that the fasteners are designed so that neighboring installation slabs are held together by the emplaced composite paving elements. The spacing between neighboring fasteners also between adjacent installation slabs via the installation slab edges is preferably constant. The fasteners on the installation slab preferably include pot-like retaining knobs that include a radially protruding edge and protrude from the baseplate of the insulation slab. The fasteners also preferably include openings made in the baseplate that have undercuts on the side facing away from the composite paving element.

The aforementioned components to be used according to the invention, are not subject to any special exceptional conditions in size, configuration and choice of material or technical design so that the selection criteria known in the corresponding area of application can be used without restriction.

Additional details, features and advantages of the object of the invention are apparent from the following description of the accompanying drawing, in which, for example, preferred variants of a composite paving element according to the invention, as well as an installation system suitable for installation of the composite paving elements and installation slabs suitable for this, are presented. In the drawing:

BRIEF DESCRIPTION OF THE DRAWINGS

Reference may now be made to the drawings, which illustrate various embodiments that the invention may take in physical form and in certain parts and arrangement of parts wherein.

Figure 1:
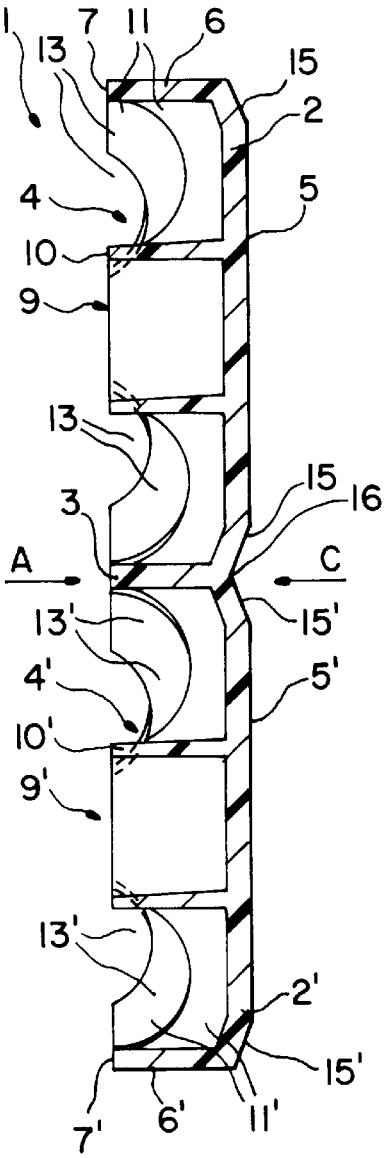
FIG. 1 shows a composite paving element according to the invention in the form of a double hexagonal element in vertical longitudinal section along line I—I according to FIG.

When "top" and "bottom" are mentioned below, they refer to a composite paving element installed on a soil or a correspondingly positioned installation slab by definition.

DETAILED DESCRIPTION OF THE PREFERRED EMBODIMENTS

Referring now to the drawings, wherein the showings are for the purpose of illustrating the preferred embodiments of the invention only and not for the purpose of limiting the same.

FIG. 1 shows a paving element 1 according to the invention made of recycled plastic in a side view of a vertical longitudinal section. The paving element in this practical example consists of a double hexagonal element, consisting of two hexagonal base elements 2, 2' with the same base dimension, which have a common joining wall 3. As is apparent from FIGS. 1 to 3, each hexagonal element 2, 2' comprises a central recess 4, 4' arranged in its bottom surface, whose upper limitation forms a closed paving top 5, 5'. The side walls 6, 6' of the central recesses 4, 4' connected to the paving top 5, 5' are perpendicular to the paving top 5, 5'. Their lower edges 7, 7' form contact surfaces by means of which an installed composite paving element 1 is supported on an installation slab (still to be described below) or on another substrate. The composite paving element 1 on its side walls 6, 6' has openings 8, 8' on the bottom side, via which the central recesses 4, 4' communicate laterally with the surroundings. The method of function of these known openings, which can form a net-like drainage system in conjunction with paving joints not shown in the drawing, is explained in detail in EP 0 524 609 A1. A circular cylindrical support element 9, 9', whose lower edge 10, 10' is situated in a plane with the lower edge 7, 7' of the side wall 6, 6' of the corresponding hexagonal element 2, 2', is arranged in the interior of the central recess 4, 4' radially symmetric to the surface center point of the bottom of the paving top. Diagonal ribs 11, 11', also connected to the bottom of paving top 5, 5', extend radially from the outer surface of support element 9, 9' to the vertical edges 12, 12' of hexagonal elements 2, 2'. The diagonal ribs 11, 11' have lower edge recesses 13, 13', via which, on the one hand, liquid exchange can occur between the individual segments 14, 14' formed by the diagonal ribs 11, 11', and on the other hand, the flexibility of the paving top 5, 5' can be varied by altering their dimensions.

Obliquely sloping chamfered surfaces 15, 15' are provided on the edges of paving top 5, 5', which together with the chamfered surfaces of a neighboring hexagonal element form channels 16 that serve to divert surface water.

Figure 2:
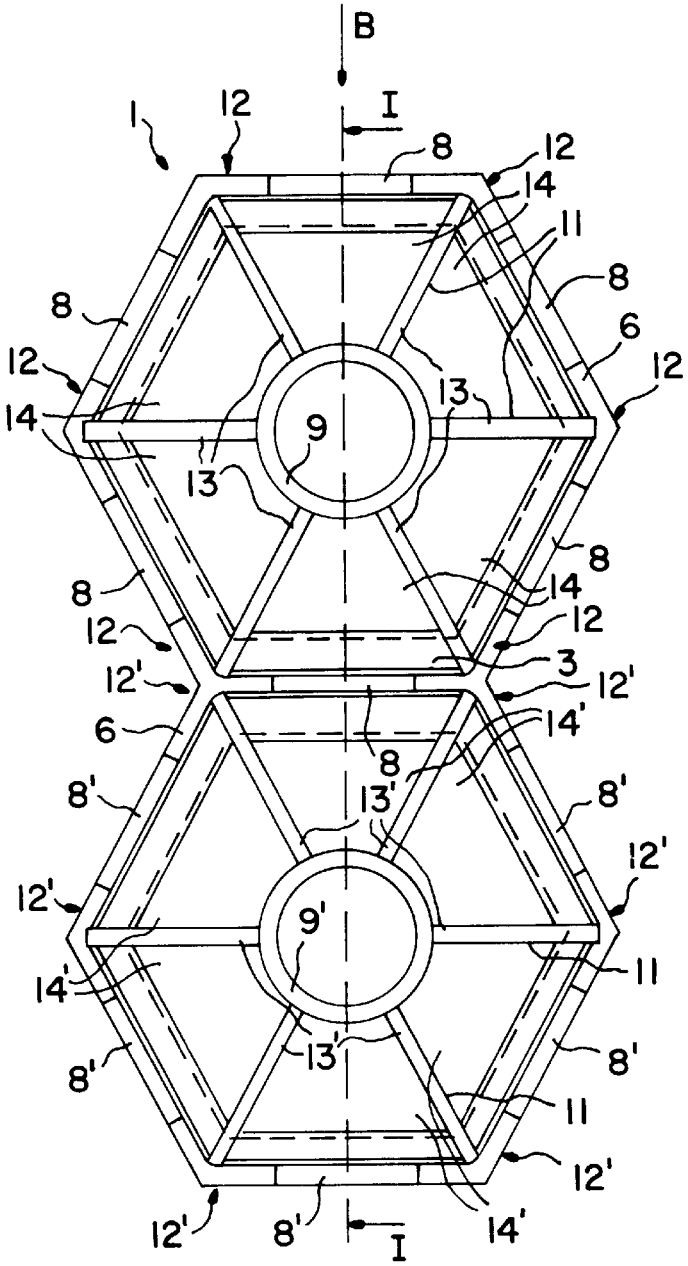
FIG. 2 shows the same composite paving element viewed from below (view A in FIG. 1)
Figure 3:
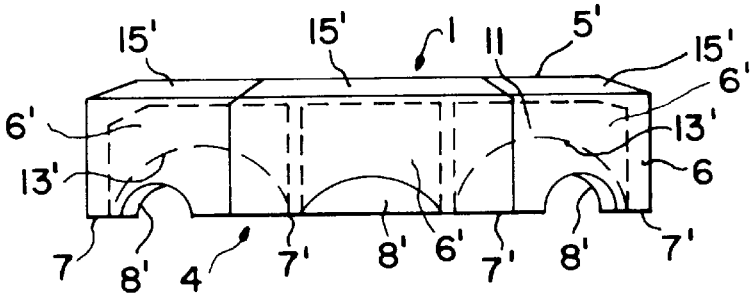
FIG. 3 shows the same composite paving element viewed on a narrow side (view B in FIG. 2)
Figure 4:
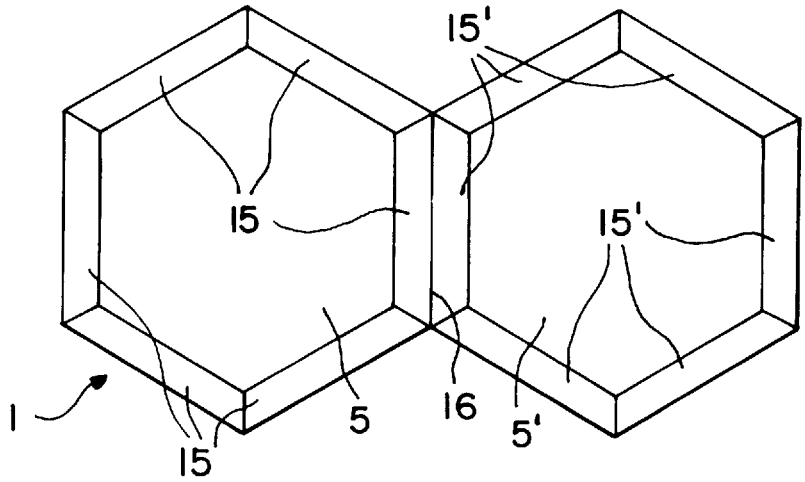
FIG. 4 shows the same composite paving element viewed from above (view C in FIG. 1)
Figure 5:
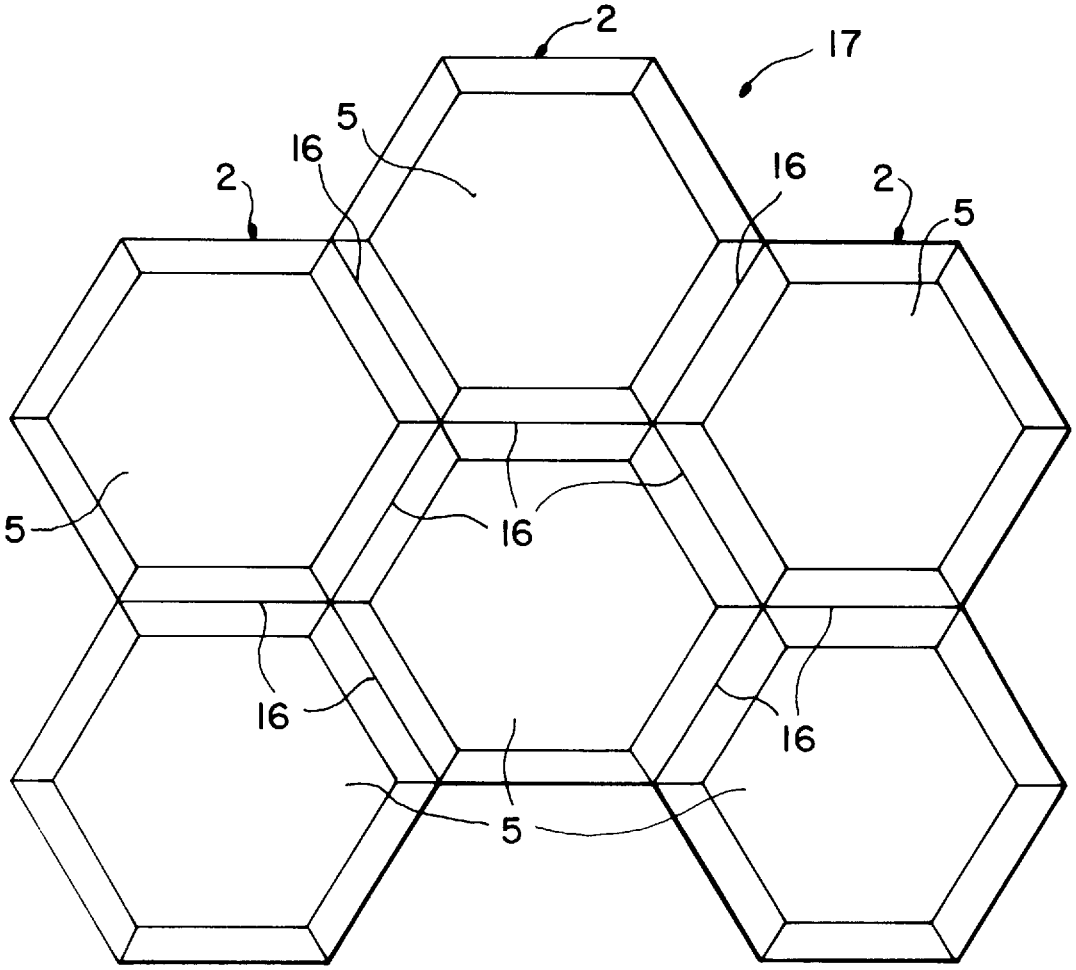
FIG. 5 shows an alternative variant of a composite paving element according to the invention in the form of a three-fold double hexagonal element viewed from above.

The practical example of a composite paving element according to the invention described in detail above with reference to FIGS. 1 to 3 involves a double hexagonal element, which is shown in FIG. 4 in a view from the top. Another preferred variant of a composite paving element, in which this is formed as a three-fold double hexagonal element 17, is shown in FIG. 5 also viewed from the top. The individual hexagonal elements correspond in configuration and function to those of the practical example depicted in FIGS. 1 to 4.

Such multiple elements can be produced in any sizes, in which individual elements connected in each case on location into a complete element preferably of hexagonal basic size, have the common connection walls 3 that are also provided with openings 8.

Figure 6:
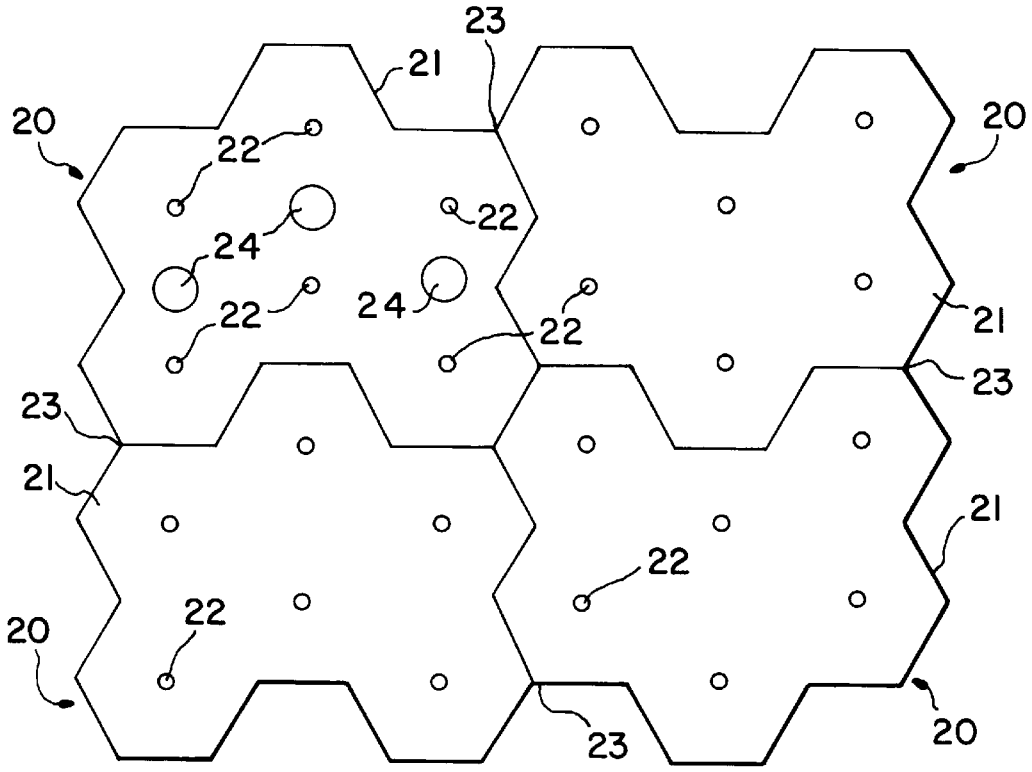
FIG. 6 shows an installation slab according to the invention viewed from above, in which four adjacent installation slabs are shown.

A variant of an installation slab 20 according to the invention is shown in FIG 6, which together with the aforementioned composite paving elements 1, 17 is to serve to form an installation system. This type of installation slab 20 consists of a baseplate 21, which in the depicted variant has the outline of a three-fold double hexagonal element and thus is also suitable to produce a true hollow-chamber composite paving element. This configuration, however, is in no case compulsory and it is also possible to make the baseplate 21 rectangular instead or produce it in a size that is a multiple of the size of the practical example depicted in FIG. 6.

In this practical example each installation slab has six fasteners 22 that are merely shown circular in the drawing.

Each of the fasteners 22 serves to attach a hexagonal element 2 of a composite paving element 1, 17 and is intended for cooperation with the central support elements 9 of a hexagonal element 2. The precise description of the embodiment of fastener 22 occurs below with reference to FIGS. 8 and 9. The fasteners 22 are arranged on the baseplate 21 so that spacing of the neighboring fasteners (also relative to those on a neighboring slab) is constant. Because of this configuration, on the one hand, optimal variability is achieved during installation of the composite paving elements 1,17 on the installation slab 20 and, on the other hand, the individual installation slabs 20 can be attached to each other, in which the composite paving elements 1, 17 are installed to span the installation slab edges 23. As shown on the example of the installation slab 20 in the top left of FIG. 6, the base plate can also be equipped with drainage openings 24 that are arranged so that they communicate with the openings 8 when the composite paving elements are emplaced. However, all other arrangements of the drainage openings 24 that do not adversely affect the installation capability of the composite paving elements 1, 17 on the installation slab 20 are also conceivable. Equipping the installation slabs according to the invention with drainage openings 24 is considered in particular when the installation slabs are applied to an absorbent substrate into which surface water can be directly introduced.

Figure 7:
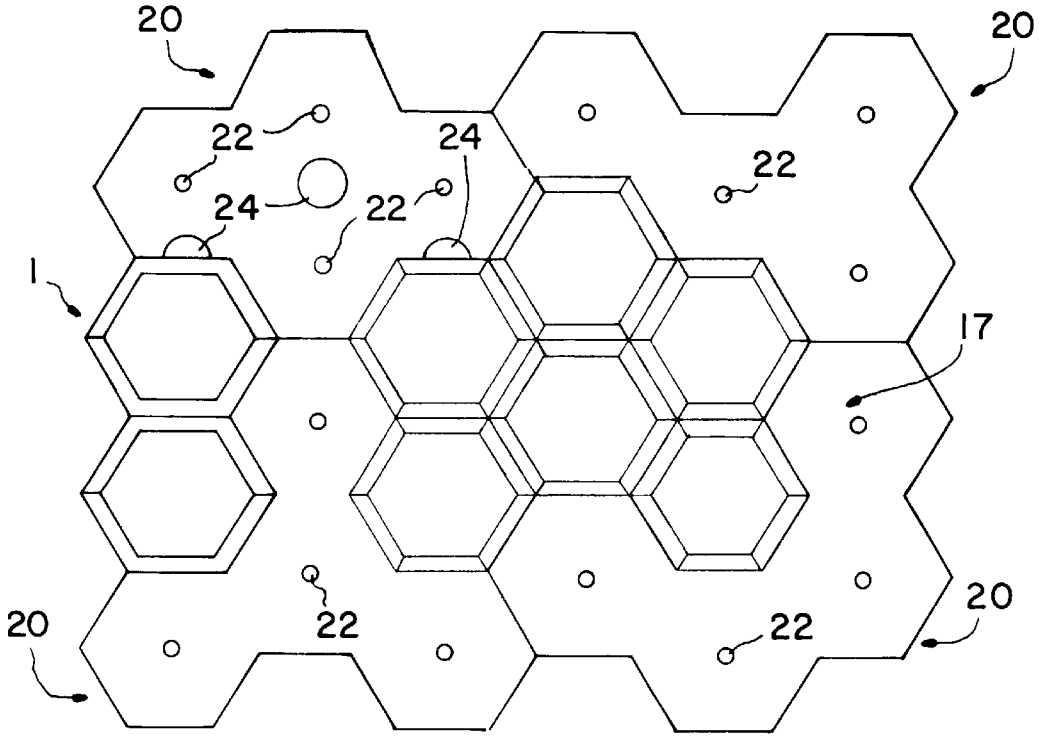
FIG. 7 shows the arrangement of the installation slabs according to FIG. 6, in which these are each fitted with a paving element according to FIG. 4 or FIG. 5 viewed from above.

An arrangement of installation slabs corresponding to those in FIG. 6 is shown in FIG. 7, onto which a double hexagonal composite paving element 1, as well as a threefold double hexagonal composite paving element 17, are applied so that they span the installation slab edges 23 and in so doing simultaneously serve for attachment of the installation slabs, as already described above.

Figure 8:
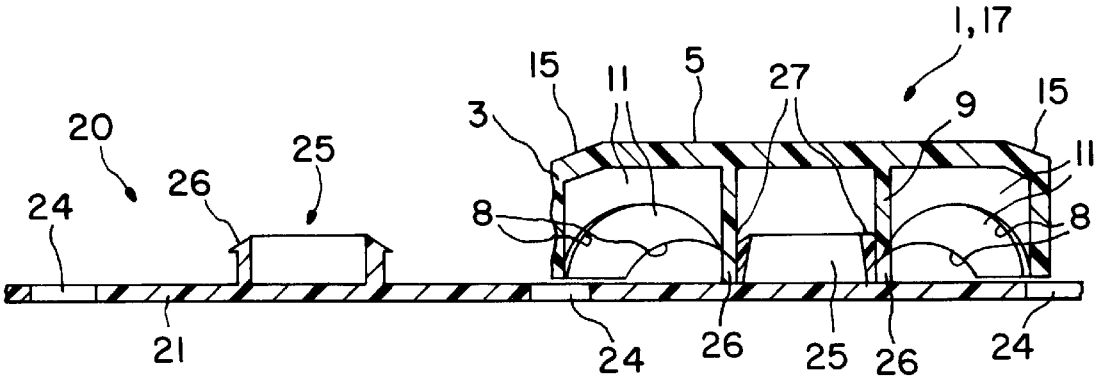
FIG. 8 shows an installation system according to the invention with fasteners to attach a paving element onto an installation slab in a vertical longitudinal section (cut-away view)

A first variant of the fasteners prescribed for attachment of the composite paving elements 1, 17 onto the insulation slab 20 is shown in FIG. 8. The fasteners consist of pot-like retaining knobs 25 that protrude upward from baseplate 21, which enclose a radially protruding edge 26 on their upper end. The diameter of the retaining knobs 25 is dimensioned so that the support element 9 of a hexagonal element 2 can be slid over a retaining knob 25 so that the protruding edge 26 hooks into an all-round groove 27 of the inside wall of the support element 9.

Figure 9:
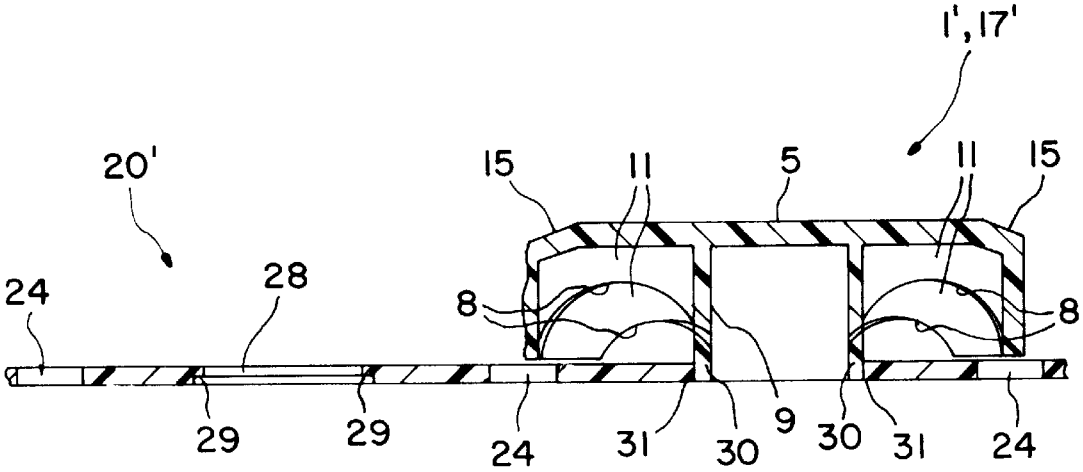
FIG. 9 shows another variant of the fasteners in the same depiction as in FIG. 8.

A second variant of the fastener is shown in FIG. 9. Openings 28 made in the installation slab that have undercuts 29 on the side facing away from composite paving element 1, 17 serve to form these. The composite paving element 1, 17 suitable for attachment to this installation slab 20' includes a downward extension 30 on the lower end of support element 9 of hexagonal element 2, which includes a continuous protrusion 30 on its outside cross section. The extension 30 and the protrusion 31 are dimensioned so that during emplacement of a composite paving element 1', 17' onto an installation slab 20' the extension 30 can be introduced into an opening 98 and the protrusion 31 after complete emplacement of the composite paving element 1', 17' automatically meshes with the undercut 29 of opening 28.

It is possible in these variants of the fastener to remove the composite paving elements and the installation slab and optionally reuse them in another location. If this feature is not desired, installed composite paving elements can also be glued to the installation slabs, in which case a configuration of the fasteners with locking devices, like grooves and protrusions or the like, can be dispensed with.

I claim:

1. An installation system for composite paving elements comprising installation slabs, composite paving elements, slab fasteners for the composite paving elements and paving fasteners designed to mesh with said slab fasteners, each of said composite paving elements including a plastic material and having a bottom surface, top surface, side walls, a central recess formed by said bottom surface and side walls, a continuous rib positioned in said central recess and connected to said bottom surface and spaced from said side walls, and a plurality of structural ribs connected to said bottom surface and connecting said continuous rib to at least two side walls, said slab fasteners connected to said installation slabs, said paving fasteners positioned on said composite paving elements and designed to connect adjacent installation slabs in conjunction with said composite paving elements.

2. A paving element system comprising a composite paving element of polygonal outline comprising a top surface lying substantially in a plane, a bottom surface, side walls running substantially perpendicular to said top surface and forming a cavity, a continuous rib in said cavity being connected to said bottom surface and running substantially perpendicular to said top surface and spaced between said side walls, a plurality of diagonally-extending structural ribs connected to said bottom surface and connecting said continuous rib to at least two of said side walls, said side walls having a lower edge spaced from said bottom surface and lying substantially in a base plane.

3. A paving element system according to claim 2, wherein said continuous rib is substantially symmetrically centered on said bottom surface and said plurality of said diagonal ribs substantially symmetrically spaced about said continuous rib.

4. A paving element system according to claim 3, including an installation slab adapted to support said composite paving element, said installation slab including means for securing said composite paving element in a substantially constant position on said installation slab.

5. A paving element system according to claim 4, wherein said securing means adapted to connect said continuous rib to said installation slab.

6. A paving element system according to claim 5, wherein said continuous rib includes a groove, said securing means includes means for connecting to said continuous rib groove.

7. A paving element system according to claim 5, wherein said bottom surface of said continuous rib extending beyond said base plane, said installation slab including a recess adapted to telescopically receive said bottom surface of said continuous rib.

8. A paving element system according to claim 5, wherein said continuous rib includes a cavity in said bottom surface, said securing means including means for being telescopically received in said bottom surface cavity of said continuous rib.

9. A paving element system according to claim 3, including an installation slab adapted to support said composite paving element, said installation slab including means for securing said composite paving element in a substantially constant position on said installation slab.

10. A paving element system according to claim 3, wherein said top surface includes a beveled side edge adapted to form a channel groove with a top surface of an adjacently positioned composite paving element.

11. A paving element system according to claim 10, wherein a portion of said lower edge of at least one side wall spaced above said base plane.

12. A paving element system according to claim 11, including an installation slab adapted to support said composite paving element, said installation slab including means for securing said composite paving element in a substantially constant position on said installation slab.

13. A paving element system according to claim 12, wherein said installation slab includes at least one drainage opening.

14. A paving element system according to claim 12, wherein said securing means adapted to connect said continuous rib to said installation slab.

15. A paving element system according to claim 14, wherein said continuous rib includes a cavity in said bottom surface, said securing means including means for being telescopically received in said bottom surface cavity of said continuous rib.

16. A paving element system according to claim 14, wherein said bottom surface of said continuous rib extending beyond said base plane, said installation slab including a recess adapted to telescopically receive said bottom surface of said continuous rib.

17. A paving element system according to claim 16, wherein said installation slab includes at least one drainage opening.

18. A paving element system according to claim 15, wherein said bottom surface cavity includes a groove, said securing means includes means for connecting to said bottom surface cavity groove.

19. A paving element system according to claim 18, wherein said installation slab includes at least one drainage opening.

20. A paving element system according to claim 2, wherein said continuous rib is a substantially cylindrically shaped rib.

21. A paving element system according to claim 2, wherein said structural ribs include a lower edge extending at least to said base plane, at least one of said structural ribs having a portion of said lower edge spaced above said base plane.

22. A paving element system according to claim 21, wherein said portion of said lower edge of said structural rib being substantially arcuate.

23. A paving element system according to claim 22, wherein said continuous rib is substantially symmetrically centered on said bottom surface and said plurality of said diagonal ribs substantially symmetrically spaced about said continuous rib.

24. A paving element system according to claim 2, wherein said continuous rib has a bottom edge extending at least to said base plane.

25. A paving element system according to claim 2, wherein said top surface includes a beveled side edge adapted to form a channel groove with a top surface of an adjacently positioned composite paving element.

26. A paving element system according to claim 2, wherein a portion of said lower edge of at least one side wall spaced above said base plane.

27. A paving element system according to claim 2, including an installation slab adapted to support said composite paving element, said installation slab including means for securing said composite paving element in a substantially constant position on said installation slab.

28. A paving element system according to claim 27, wherein said securing means adapted to connect said continuous rib to said installation slab.

29. A paving element system according to claim 28, wherein said continuous rib includes a cavity in said bottom surface, said securing means including means for being telescopically received in said bottom surface cavity of said continuous rib.

30. A paving element system according to claim 29, wherein said bottom surface cavity includes a groove, said securing means includes means for connecting to said bottom surface cavity groove.

31. A paving element system according to claim 27, wherein said installation slab includes at least one drainage opening.

32. A paving element system according to claim 28, wherein said bottom surface of said continuous rib extending beyond said base plane, said installation slab including a recess adapted to telescopically receive said bottom surface of said continuous rib.

33. A multi-cornered composite paving element of plastic having a central recess disposed in a floor surface, having side walls extending approximately perpendicular to a paving cover of the composite paving element and having vertical edges forming from the side walls and having lower edges forming from said vertical edges, wherein circumferentially-extending and diagonally-extending ribs are provided in the central recess extending approximately perpendicular from the paving cover, characterized in that exactly one circumferential rib, extending essentially radially-symmetric to the floor surface mid-point of the underside of the central recess and having a lower edge, is provided in the central recess, and that the diagonal ribs, which combine the circumferentially-extending rib exclusively with the vertical edges of the composite paving element, generally extend radially.

34. The composite paving element as defined in claim 33, characterized in that the circumferential ribs is formed by a cylindrical support element.

35. The composite paving element as defined in claim 34, characterized in that the diagonal ribs include a lower edge and said lower edge exhibits a lower edge recess.

36. The composite paving element as defined in claim 35, characterized in that the lower edge of the circumferential rib lies in a plane with the lower edges of the composite paving element.

37. The composite paving element as defined in claim 36, characterized in that means for anchoring the composite paving element on an installation plate are provided on the circumferential rib.

38. The composite paving element as defined in claim 37, characterized in that the means for anchoring consists of an all-around groove incorporated in the inner cross-section of the circumferential rib.

39. The composite paving element as defined in claim 37, characterized in that the means for anchoring consists of a prolongation extending from the lower edge of the circumferential rib, wherein said prolongation comprises an outer cross section and said cross section having at least one of a circumferential projection and a plurality of individual projections.

40. The composite paving element as defined in claim 33, characterized in that the diagonal ribs include a lower edge and said lower edge exhibits a lower edge recess.

41. The composite paving element as defined in claim 40, characterized in that the lower edge of the circumferential rib lies in a plane with the lower edges of the composite paving element.

42. The composite paving element as defined in claim 41, characterized in that means for anchoring the composite paving element on an installation plate are provided on the circumferential rib.

43. The composite paving element as defined in claim 33, characterized in that the lower edge of the circumferential rib lies in a plane with the lower edges of the composite paving element.

44. The composite paving element as defined in claim 43, characterized in that means for anchoring the composite paving element on an installation plate are provided on the circumferential rib.

45. The composite paving element as defined in claim 33, characterized in that means for anchoring the composite paving element on an installation plate are provided on the circumferential rib.

46. The composite paving element as defined in claim 45, characterized in that the means for anchoring consists of an all-around groove incorporated in the inner cross-section of the circumferential rib.

47. The composite paving element as defined in claim 45, characterized in that the means for anchoring consists of a prolongation extending from the lower edge of the circumferential rib, wherein said prolongation comprises an outer cross section and said cross section having at least one of a circumferential projection and a plurality of individual projections.

48. An installation system for composite paving elements, characterized in that the installation system comprises installation plates and a multi-cornered composite paving element and mounting means for mounting the composite paving element on said installation plates, said mounting means being structured such that adjacent installation plates are fixed to one another by mounted composite paving elements.

* * * * *